US006985058B2

(12) United States Patent
D'Amico et al.

(10) Patent No.: US 6,985,058 B2
(45) Date of Patent: Jan. 10, 2006

(54) LORENTZ FORCE ASSISTED SWITCH

(75) Inventors: William P. D'Amico, Baltimore, MD (US); John L. Champion, Highland, MD (US); Gabriel M. Rebeiz, Ann Arbor, MI (US); Dennis K. Wickenden, Woodbine, MD (US); Robert B. Givens, Frederick, MD (US)

(73) Assignee: The Johns Hopkins University, Baltimore, MD (US)

( * ) Notice: Subject to any disclaimer, the term of this patent is extended or adjusted under 35 U.S.C. 154(b) by 184 days.

(21) Appl. No.: 10/664,315

(22) Filed: Sep. 17, 2003

(65) Prior Publication Data

US 2004/0108195 A1 Jun. 10, 2004

Related U.S. Application Data

(60) Provisional application No. 60/411,377, filed on Sep. 17, 2002.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 4,169,999 | A | 10/1979 | Kishel | |
| 4,841,834 | A | 6/1989 | Gruden | |
| 5,322,258 | A * | 6/1994 | Bosch et al. | 251/65 |
| 5,847,474 | A | 12/1998 | Gruden et al. | |
| 5,872,384 | A | 2/1999 | Gabara | |
| 6,657,525 | B1 * | 12/2003 | Dickens et al. | 335/78 |

* cited by examiner

*Primary Examiner*—Lincoln Donovan
*Assistant Examiner*—Bernard Rojas
(74) *Attorney, Agent, or Firm*—Albert J. Fasulo, II

(57) ABSTRACT

A Lorentz force assisted microelectromechanical switch is provided which is configured to have a capacitive switch and an electrical conductor placed in transversely extending electric and magnetic fields to generate the Lorentz force sufficient to operate the capacitive switch.

7 Claims, 4 Drawing Sheets

LORENTZ FORCE ASSISTED SWITCH

CROSS-REFERENCE TO RELATED APPLICATION

This application claims the benefit of U.S. Provisional Application No. 60/411,377, filed Sep. 17, 2002, the contents of which are incorporated herein by reference.

BACKGROUND OF THE INVENTION

1. Field of the Invention

The present invention relates generally to a capacitive microelectromechanical switch based on utilization of the Lorentz force.

2. Description of the Related Art

There now exists a small but growing number of microelectromechanical systems (MEMS) including micro-actuators; examples of which are switches, resonant magnetometers, micro mirrors, micro valves, etc. A typical MEMS shunt switch 10, as illustrated in FIG. 1, includes a beam bridge 12 of length L, width w, and thickness t, and a pull-down electrode 14 having a length W and spaced from the beam bridge 12 to form a gap 16 of width g. When a voltage V is applied, the electrostatic force F causing the bridge to deflect toward a substrate 18 is given by the following equation:

$$F = \frac{\varepsilon_0 W w}{2g} V^2 (N) \tag{I}$$

where $\epsilon_0 = 8.854 \times 10^{-12}$ $C^2/N\text{-}m^2$, where C is coulombs and N is Newtons. As the gap 16 decreases, the electrostatic force increases. When the deflection is greater than approximately ⅓ of the initial gap 16, this force exceeds the restoring force of the bridge and causes the switch to snap closed. The minimum voltage that causes this to happen (pull-down voltage, $V_p$) is given by the following equation:

$$V_p = \sqrt{\frac{8k}{27\varepsilon_0 W w} g^3}\ V \tag{II}$$

where k is the spring constant.

Accordingly, to actuate a MEMS-based switch having the gap 16 of from 1.5 to 5 micrometers, typically it is required that a pull-down voltage be from 30 to 90 V. In the context of MEMS, these voltages are high enough to create problems associated with energy losses, processing and reliability.

A need therefore exists for a MEMS-based switch actuateable by a relatively low pull-down voltage.

SUMMARY OF THE INVENTION

This need is met by an MEMS-based capacitive switch of the present invention utilizing the Lorentz force, which is produced as a result of coupling between magnetic and electric fields applied across the switch. Accordingly, since the switch actuation is a function of the Lorentz force combined with an actuation voltage, as the Lorentz force increases, the actuation electrostatic pull-down voltage decreases.

Structurally, the MEMS-based switch of the present invention is configured with a source generating a magnetic field across the switch, and an electrical conductor carrying a current and extending transversely to the magnetic field. Coupling the electric and magnetic fields produces the Lorentz force sufficient to assist in displacement of the electrical conductor between two positions corresponding to the on- and off-states of the switch in accordance with a direction of current flow through the electrical conductor.

BRIEF DESCRIPTION OF THE DRAWINGS

The above and other features, as well as advantages and objects of this invention will become more readily apparent from the following description of the preferred embodiment accompanied by the attached drawings, in which.

DETAILED DESCRIPTION OF THE PREFERRED EMBODIMENT

Figure 1:
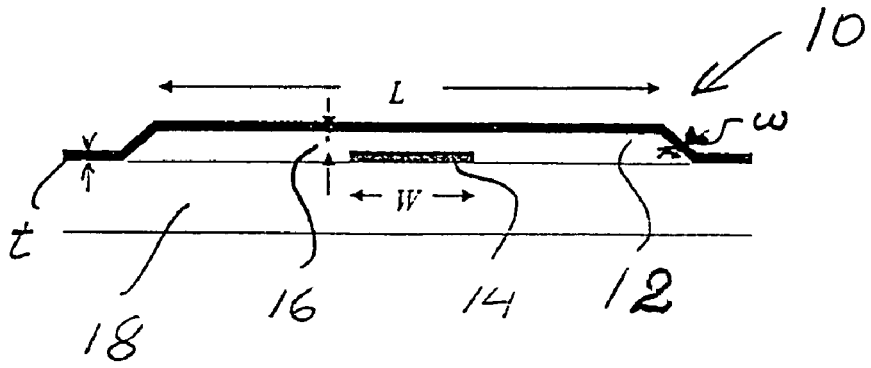
FIG. 1 PRIOR ART
FIG. 1 is a schematic diagram of a MEMS-based switch configured in accordance with the known prior art.
Figure 2:
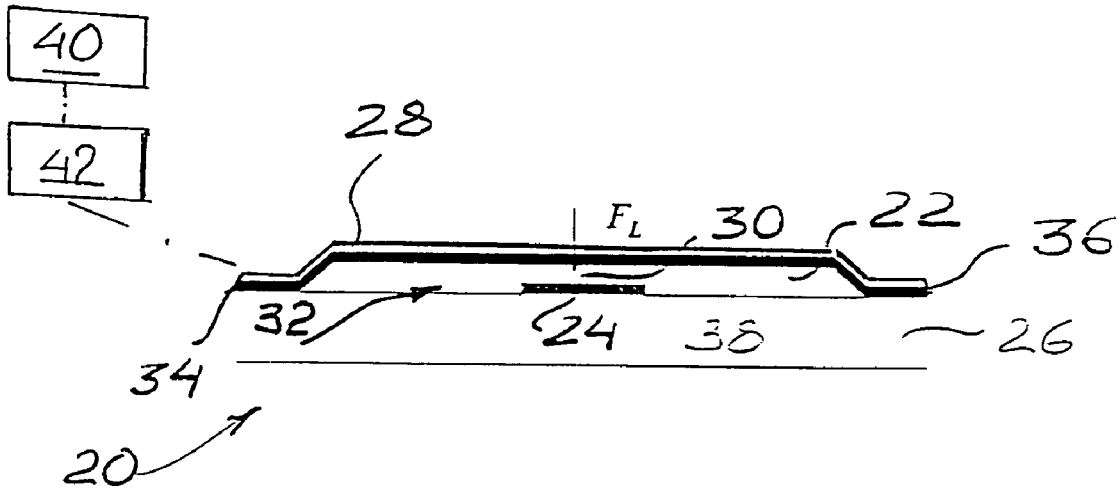
FIG. 2 is a schematic side view of a MEMS-based switch configured in accordance with the invention.
Figure 3:
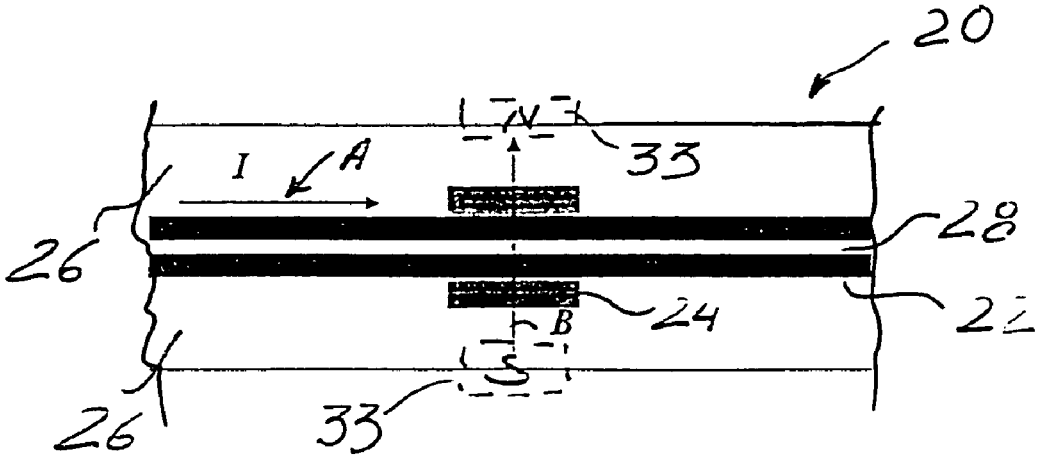
FIG. 3 is a top view of the MEMS-based switch of FIG. 2.

Referring to FIGS. 2 and 3, a microelectromechanical (MEMS) switching device 20 of the present invention is formed on a substrate 26, and includes a MEMS capacitive switching assembly 32 operative to couple spaced apart contacts by utilizing Lorentz force. The switching assembly 32 includes a beam bridge 22 and a fixed pull-down electrode 24 supported by the substrate and spaced from the bridge 22. A dielectric layer 30 separating the bridge and the pull-down electrode, which both are made from a metal, polysilicon or a combination of these, prevents shorting therebetween in the off-state of the switch 20, as shown in FIG. 2.

To provide the bridge 22 with the desired flexibility, only its opposite ends 34, 36 are supported by the substrate 26, whereas an inner span 38 of the bridge is separated from the substrate by, for example, undercutting or underetching. As a consequence, the unsupported span 38 of the bridge 22 is capable of flexing towards the substrate 26 to contact the pull-down electrode 24 and, thus, to define the on-state of the device 20 once a voltage applied to the switch overcomes the restoring force of the bridge 22.

In accordance with the present invention, the bridge 22 is juxtaposed with an electrical conductor 28 made from flexible conducting or semi-conducting materials and coupled to an electric field generating source 40 to conduct a current I (FIG. 3) along the direction of arrow A. To produce the Lorentz force $F_L$, the conductor 28 is placed within a magnetic field B generated by a source 33 and extending coplanar with but transversely to the electric field. As a consequence, the Lorentz force $F_L$, as better seen in FIG. 2, extends in a plane perpendicular to the plane of the electric and magnetic fields and is applied to the bridge 22 so that the latter flexes towards the pull-down electrode 24 formed on the substrate 26. Assuming that the direction of arrow A indicates the direction of current associated with the on-state of the switch 20, reversing the direction of the current I along the conductor 28 in the presence of the magnetic field B would generate the Lorentz force directed away from the pull-down electrode 24. Accordingly, once the direction of the current I is changed, the bridge 22 and the pull-down electrode 24 are decoupled to define the off-state of the switch 20.

The source 40 is preferably an electric pulse generator, which is coupled to a pulse duration modulator 42 operative to control the duration of pulses, which are preferably relatively short to minimize Joule heating that, if not controlled, can lead to overheating of the bridge 22 and the pull-down electrode 24. The source 33 generating the magnetic field B may include permanent magnets capable of generating high magnetic fields, a coil or a thin film deposited on the substrate 26.

Figure 4:
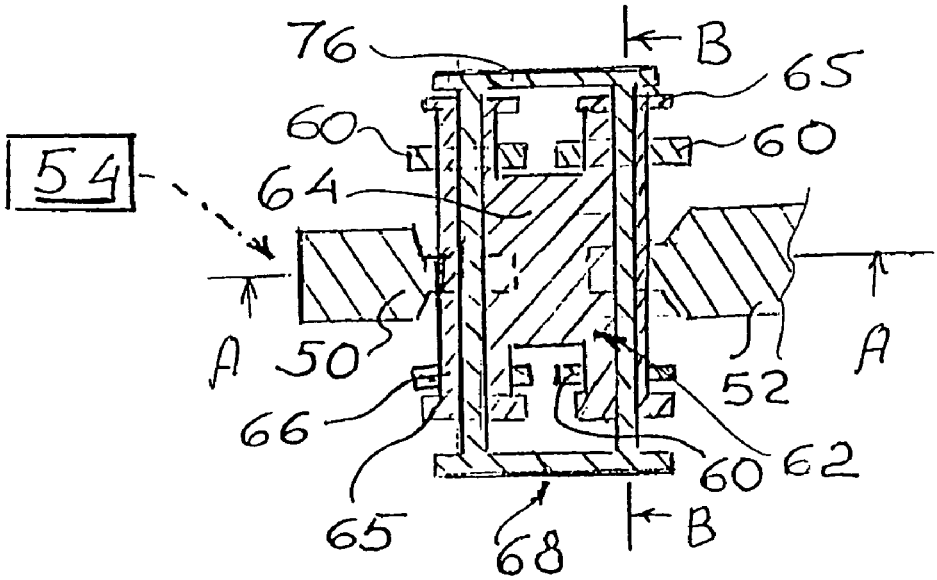
FIG. 4 is a sectional top view of the embodiment of the inventive MEMS-based switch of FIGS. 2 and 3.
Figure 5:
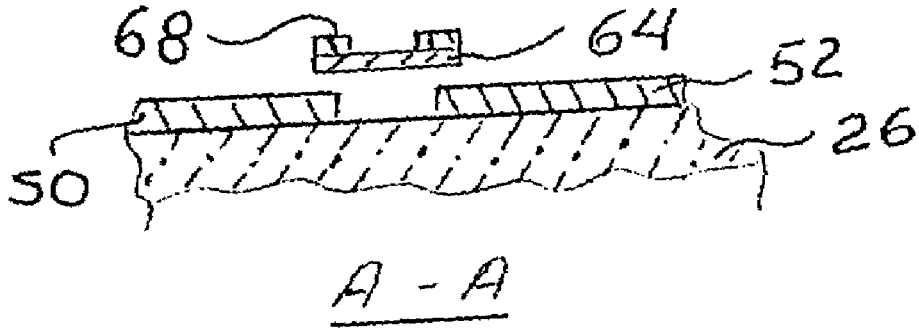
FIG. 5 is a cross-sectional view of the inventive MEMS-based switch taken along lines A—A of FIG. 4.
Figure 6:
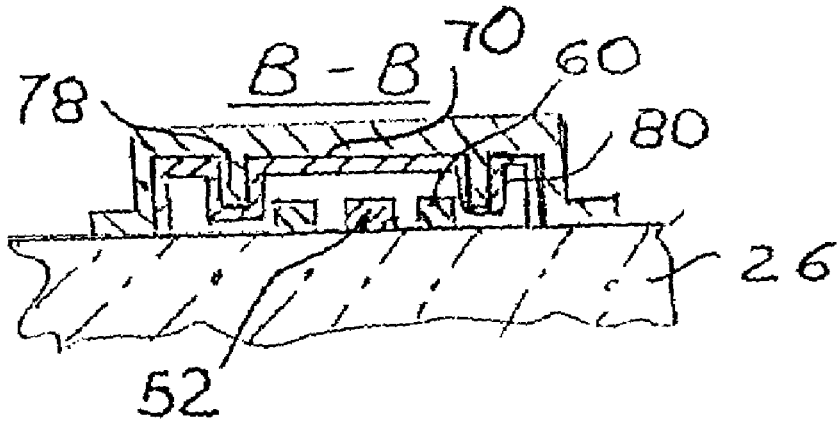
FIG. 6 is a sectional view of the inventive MEMS-based switch taken along lines B—B, as shown in FIG. 4; and, FIG. 7 is a graph illustrating magnetic fields required to produce the Lorentz forces in a 0–40 $\mu$N range for drive currents of 0.5, 1.0, and 5.0 Amps in the MEMS-based device of the present invention.

Referring to FIGS. 4–6, showing the layout and cross-sections of the exemplary embodiment of the inventive switch 20 operative to couple contacts 50, 52 provided on the substrate 26 to transmit and output a signal 54 in both the RF and millimeter bands. Consonant to the inventive concept, the switch has a beam bridge 62 displaceable towards a pull-down electrode 60 in response to the Lorentz force produced upon coupling transversely extending magnetic and electric fields. To provide a reliable contact between the bridge 62 and the pull-down electrode 60, the latter may have one or multiple components. For example, FIG. 4 illustrates four pull-down electrodes 60 positioned equidistantly from one another to form an imaginary square. The bridge 62 is configured to have a central body 64 located above and configured to overlap all four pull-down electrodes 60 to ensure a reliable electrical contact therewith. The shape of the central body 64 may have a circular, polygonal or even an irregular shape as long as the body is sized to form overlapping regions with the pull-down electrodes 60. To facilitate displacement of the bridge 62 in response to application of the actuation voltage and the Lorentz force, its central body 64 further has multiple legs 66 each provided with a width substantially smaller than the body 64. The legs 66, each terminating in a respective pad 65, which is supported by the substrate 26, act as hinges bent by the Lorentz force exerted by a conductor 68, which lies in transversely extending magnetic and electrical fields and is coupled to the bridge 62.

While the conductor 68 does not necessarily have to contact the bridge 62 directly, preferably, the latter provides a support top surface 70 (FIG. 6) directly contacting the conductor 68. As illustrated in FIG. 4, the conductor 68 has a frame made from a low resistance material and including a pair of spaced apart flat strips or circular wires 72 bridging supports 76, which are provided on the substrate 26. Reliable coupling between the bridge 62 and the conductor 68 is realized by engagement between formations 78 and 80 provided on the inner side of the strips 72 of the conductor 68 and the pads 65 of the bridge 62. These formations may include protrusions and indentations provided on the opposing surfaces of the bridge and the conductor and shaped and dimensioned to extend complementary to one another. Such a connection between the bridge 62 and the conductor 68 provides for their synchronous displacement towards and away from the pull-down electrode 60 in response to the application of the Lorentz force.

The Lorentz force generated by a current in a magnetic field B, which is applied in the plane of and perpendicular to the longitudinal direction of the bridge, is given by the following equation:

$$F_L = B \times I \times L \qquad \text{(III)}$$

where I is the current, B is the magnetic field and L is the length of the conductor. The direction of the force is defined by the direction in which the current flows. Alternatively, the direction of the force may be controlled by changing the direction of the magnetic field if the latter is generated by an external source, provided, of course, that such a structure would meet the local requirements.

Figure 7:
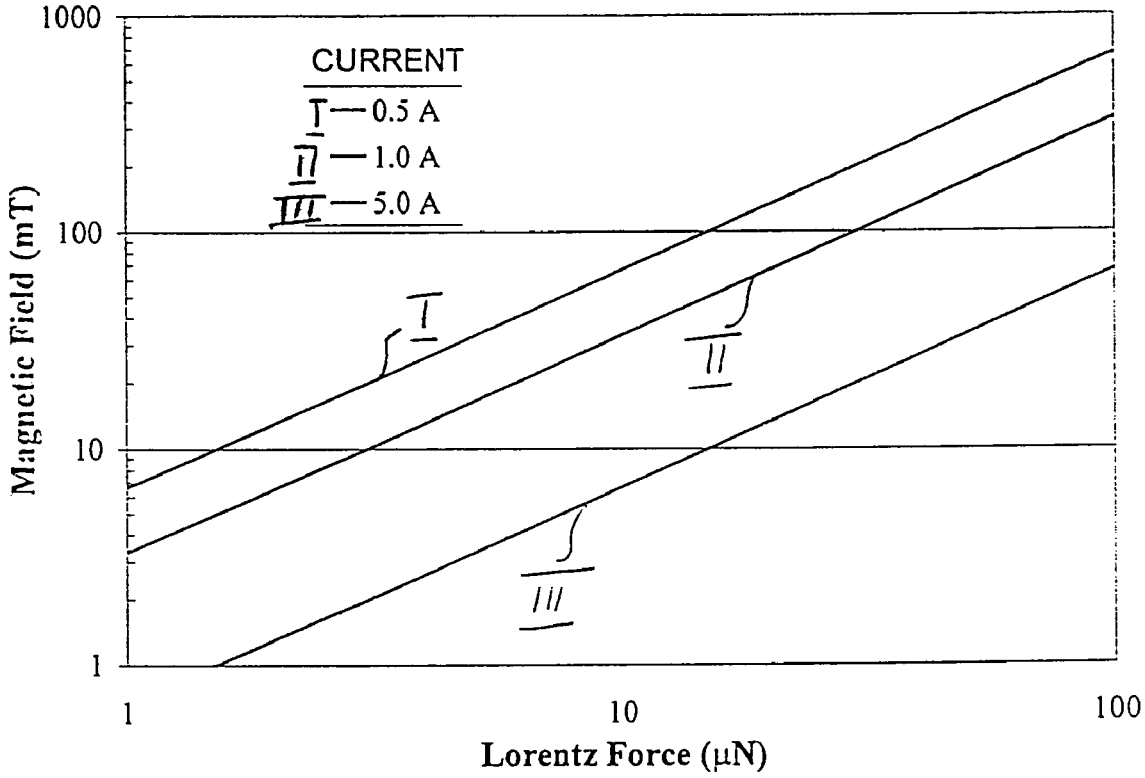

The magnetic fields required to produce forces comparable to electrostatic pull-down forces in the bridge of 300 $\mu$m length in the range of $1–100\times10^{-6}$ N with drive currents of 0.5, 1.0, and 5.0 A are shown in FIG. 7. It can be seen that in order to produce a Lorentz force of 10 $\mu$N, a field of 67 mT is required for a 0.5 A drive current and 7 mT for a 5 A drive current. Based on the empirical data, the pull-down voltage results in a force that causes the beam to deflect only ⅓ of the initial gap width. If the Lorentz force acts alone on the switch, a factor of at least 3 must be allowed to effect switch closure, i.e. 50 $\mu$N for a 1.5 $\mu$m gap and 100 $\mu$N for a 3.0 $\mu$m gap. This will increase the field requirement proportionately.

Thus, in the switch of the present invention, which can be integrated in, for example, micromotors, microvalves, mechanical resonators, etc., the Lorentz force is used to reduce the gap between the bridge and the pull-down electrode of the switch from its "full up" position, as shown in FIG. 5, to a distance close enough that a lower voltage ranging between 5 to 10 V will cause the bridge to snap down. From equation (2) given above in paragraph four (4), and assuming that 90 V is required to pull-down the bridge with a 3 $\mu$m gap, the gaps are 0.44 and 0.69 $\mu$m for pull-down voltages of 5 and 10 V, respectively. These values represent a "saving" of 15% and 23% of the Lorentz force required in the unassisted case.

It will be understood that various modifications may be made to the embodiments disclosed herein. Therefore, the above description should not be construed as limiting the scope of the invention, but merely as exemplifications of the preferred embodiments. Those skilled in the art will envision other modifications within the scope and spirit of the claims appended hereto.

What is claimed is:

1. A switching device comprising:

a capacitive switch;

a magnetic field source operative to apply a magnetic field across the switch; and an electrical conductor providing there along a path of conduction of a current in opposite directions, the electrical conductor being juxtaposed with the capacitive switch and extending transversely to the magnetic field for triggering the capacitive switch between an on- and off-state in accordance with a direction of current flow along the electrical conductor, wherein the capacitive switch is an electrostatic switch, the switching device being a microelectromechanical Lorentz-force assisted switching device, wherein the electrostatic switch is configured to have a pull-down electrode continuously supported by a substrate and a bridge straddling the pull-down electrode and being operative to move towards and away from the pull-down electrode in accordance with the direction of current flow along the electrical conductor to selectively set the on- and off-state of the capacitive switch, wherein the bridge has a central body elevated above the pull-down electrode in the off-state of the capacitive switch and spaced apart pads coupled to the central body and supported on the substrate, and wherein the bridge further includes multiple hinges having a width narrower than a width of the central body and extending between the central body and the pads.

2. A switching device comprising:

a capacitive switch;

a magnetic field source operative to apply a magnetic field across the switch; and an electrical conductor providing there along a path of conduction of a current in opposite directions, the electrical conductor being juxtaposed with the capacitive switch and extending transversely to the magnetic field for triggering the capacitive switch between an on- and off-state in accordance with a direction of current flow along the electrical conductor, wherein the capacitive switch is an electrostatic switch, the switching device being a microelectromechanical Lorentz-force assisted switching device, wherein the electrostatic switch is configured to have a pull-down electrode continuously supported by a substrate and a bridge straddling the pull-down electrode and being operative to move towards and away from the pull-down electrode in accordance with the direction of current flow along the electrical conductor to selectively set the on- and off-state of the capacitive switch, wherein the electrical conductor is provided on a top surface of the bridge, and wherein the electrical conductor has a frame configured to have a pair of spaced-apart strips or wires attached to the bridge of the electrostatic switch and end supports bridging the spaced apart strips or wires and formed on the substrate.

3. The switching device of claim 1, wherein the strips or wires and the bridge have at least one projection and indentation, respectively, provided with opposing surfaces which extend complementary to and engage one another to provide the electrical conductor and the bridge with synchronous displacement between the on- and off-state of the electrostatic switch.

4. The switching device of claim 1 or 2, further comprising an electric source coupled to the electrical conductor and a magnetic field generating source selected from a permanent magnet or a coil, wherein coupling of the magnetic and electric fields produces Lorentz force directed substantially perpendicular to the magnetic and electric fields.

5. The switching device of claim 4, wherein the electric source generates a pulse-shaped signal, the switching device further comprising a device for reversing the direction of current flow along the electrical conductor.

6. A microelectromechanical system (MEMS) switch comprising:

a substrate;

multiple contacts spaced from one another and supported by the substrate; and a capacitive switching assembly provided on the substrate and positionable in magnetic and electrical fields extending coplanar with but transversely to one another to generate a Lorentz force applied to the capacitive switching assembly to selectively short the multiple contacts, wherein the capacitive switching assembly is an electrostatic switch including a pull-down electrode fixed to the substrate, a flexible bridge having opposite ends, which flank the pull-down electrode, and a central body extending between the opposite ends and facing the pull-down electrode, and a flexible conductor extending on top of and coupled to the bridge so that the coupled flexible conductor and bridge provide a path of conduction of a current between the multiple contacts, the magnetic filed extending coplanar with the flexible bridge but transversely to the path of conduction, whereas the Lorentz force is produced and extends in a plane lying substantially perpendicular to a plane of the flexible bridge.

7. The MEMS switch of claim 6, wherein the coupled flexible conductor and bridge flex synchronously toward the substrate to short the multiple contacts upon directing a current flow along the path in one direction and deflect from the multiple contacts upon reversing the current flow along the path.

* * * * *

UNITED STATES PATENT AND TRADEMARK OFFICE

CERTIFICATE OF CORRECTION

PATENT NO. : 6,985,058 B2
DATED : January 10, 2006
INVENTOR(S) : William P. D'Amico et al.

It is certified that error appears in the above-identified patent and that said Letters Patent is hereby corrected as shown below:

Column 5,
Line 40, delete "1" and insert -- 2 --.

Signed and Sealed this

Eleventh Day of April, 2006

JON W. DUDAS
*Director of the United States Patent and Trademark Office*